United States Patent [19]

Gordon et al.

[11] Patent Number: 4,632,033

[45] Date of Patent: Dec. 30, 1986

[54] DETONATOR FOR RIFLE GRENADES OR THE LIKE

[75] Inventors: Tsvi J. Gordon; Sorek Shmuel; David Moseinco, all of Jerusalem, Israel

[73] Assignee: The State of Israel, Ministry of Defence, Israel Military Industries, Israel

[21] Appl. No.: 619,358

[22] Filed: Jun. 11, 1984

[51] Int. Cl.[4] ..... F42C 15/02; F42C 15/22

[52] U.S. Cl. ..... 102/252; 102/239; 102/253; 102/272

[58] Field of Search ..... 102/249, 251–253, 102/272, 223, 228, 482–485, 229–231, 233–236, 246

[56] References Cited

U.S. PATENT DOCUMENTS

| | | | |
|---|---|---|---|
| 1,449,245 | 3/1923 | Pinkerton | 102/252 |
| 2,448,121 | 8/1948 | Porter | 102/235 |
| 2,619,905 | 12/1952 | Apothéloz | 102/272 X |
| 3,814,018 | 6/1974 | Daniel | 102/253 |
| 4,457,232 | 7/1984 | Post | 102/236 X |

FOREIGN PATENT DOCUMENTS

| | | | |
|---|---|---|---|
| 1118060 | 11/1961 | Fed. Rep. of Germany | 102/249 |
| 178073 | 1/1962 | Sweden | 102/251 |

*Primary Examiner*—David H. Brown
*Attorney, Agent, or Firm*—Steinbert & Raskin

[57] ABSTRACT

A fuze of the type used in a rifle grenade assembly with a striker, a rotor and a rotor lock includes one or more improvements. One pertains to the striker to prevent it from reaching a detonator-striking forward position more than once. Once it advances to the forward position it is locked in it by a spring biased locking pin. Other improvements relate to the release of the rotor by the rotor lock. The rotor remains locked, i.e. in the disarmed state even after intentional launching. It is released to assume the armed state only when the launched assembly accelerates at a certain rate toward the target.

3 Claims, 9 Drawing Figures

DETONATOR FOR RIFLE GRENADES OR THE LIKE

BACKGROUND OF THE INVENTION

1. Field of the Invention

The present invention is generally directed to improvements in a fuze of the type used in rifle grenades and the like and, more particularly, to improvements in such a fuze which includes a striker and rotor locking pin.

2. Description of the Prior Art

A prior art fuze, which is used among others in rifle grenades, with a striker and a rotor locking pin, or rotor lock, is, well known. Briefly, such a fuze is activated by pressure, e.g. of gases from a cartridge fired in the rifle when the latter's trigger is pressed. The pressure pushes a diaphragm foreward or fore and thereby pushes an arming pin fore. At the fore end the fuze includes a striker, which is spring biased away from the grenade, i.e. back or aft. However, a retaining steel ball prevents the striker from moving aft until the arming pin moves fore to enable the steel ball associated with the striker to be cleared out of the way, only then can the striker move back. This represents the striker's armed state.

Similarly, the fuze includes a rotor lock which is spring biased away from the rotor into which the front end of the rotor lock extends. A steel ball, associated with the rotor lock, prevents the rotor lock from exiting the rotor until the arming pin moves fore and the steel ball is out of the way. Only then is the rotor lock biased in a direction away from the rotor. Once the rotor lock clears the rotor the latter starts rotating after a preset delay. The delay is chosen to insure that the detonator matter in a hole in the rotor is aligned with the striker only after the grenade has travelled a safe distance away from the rifle-bearing soldier.

As the target is hit the striker is urged forward by deceleration forces and strikes the detonator. It in turn activates pyrotechnic matter which in turn causes the grenade to explode. Such a fuze has been used for quite a number of years in many countries in large numbers. Although such a fuze has been very popular it is believed that several improvements can be made to increase the safety provided by the fuze.

SUMMARY OF THE INVENTION

The improvements relate to locking the striker in a forward position, once reaching this state, and to controlling the rotor lock to unlock the rotor only upon the fuze being subject to a preselected acceleration. The improvement related to striker locking may be summarized as:

In a fuze included in an assembly of the type used in connection with a rifle to launch and carry the assembly together with explosives to a target whereat the explosives explode as a result of the striking of detonator means by a striker of the fuze which in the armed state is biased by a spring away from the detonator means and which as a result of the impact with a target is urged forward against the detonator means to thus initiate the detonation of the explosives, an improvement comprising:

means for locking said striker once it has moved to a forward position irrespective of the presence or absence of detonator means ahead of it to prevent successive positioning of the striker in the forward position.

The novel features of the invention are set forth with particularity in the appended claims. The invention will best be understood from the following description when read in conjunction with the accompanying drawings.

DETAILED DESCRIPTION OF THE PREFERRED EMBODIMENTS

Figure 1A:
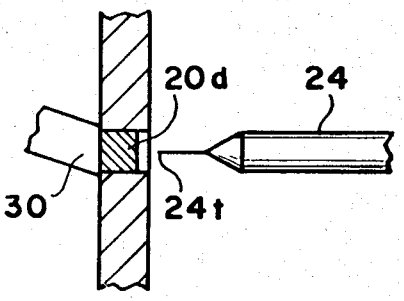
Fig. 1A PRIOR ART
FIG. 1A is a simple diagram to explain the detonation striker alignment.

The prior art fuze, which was described herebefore, will be referred to as the "standard fuze" to distinguish it from the fuze, modified in accordance with the present invention. Although the standard fuze is well known it is believed that a description of its operation will be helpful to appreciate the novel and unique advantages gained with the modifications, in accordance with the present invention. To this end attention is directed to FIG. 1 in which the standard fuze is shown in partial cross-section and partial side view. Only those elements with which the invention is concerned will be described. The fore and aft ends of the fuze facing the grenade and the direction from which pressure is received by the fuze to cock or arm the fuze, are designated by 10*f* and 10*a*, respectively. The standard fuze includes several basic parts. It includes a bendable diaphragm 12, an arming pin 15 and a shearing pin 16. It further includes a rotor 20, a rotor locking pin, or simply rotor lock 22 and a striker 24. The fore end of rotor lock 22, designated 22*f*, extends into a hole 20*h* of the rotor 20 when the fuze is in the disarmed state, as shown in FIG. 1. As long as the rotor lock's front end 22*f* extends into the hole 20*h* the rotor cannot turn and thus the fuze is disarmed.

The fuze is disarmed even though a spring 22*s*, associated with the rotor lock tends to bias the latter away from the rotor. This is due to the presence of a ball, typically of steel, designated by 22*b*, and the shape or diameter of the top or fore end 15*f* of arming pin 15. The diameter of 15*f*, designated D1, is such that there is no room for the rotor lock ball 22*b* to be pushed out of the way of the aft end of rotor lock 22.

Likewise, associated with striker 24 is a spring 24*s*, which biases the striker aft and away from the rotor 20. However, a ball 24*b* is pressed against the fore end 15*f* of the arming pin 15. Thus the striker is prevented from moving aft as long as the ball 24*b* is in the position, as shown.

As shown, the section of the arming pin 15 just aft of section 15*f* is of a smaller diameter than D1, thus forming a radial inwardly directed cavity 15*c*. As is known, when the arming pin 15 is forced toward the fore end 10*f* of the fuze 10 at some point the balls 22*b* and 24*b* face cavity 15*c*. The aft end of each of rotor lock 22 and striker 24 is shaped so that as it is backward biased by its associated spring and the set-back forces and as it moves aft it applies a force to its associate ball which is pushed into cavity 15*c*.

Figure 1:
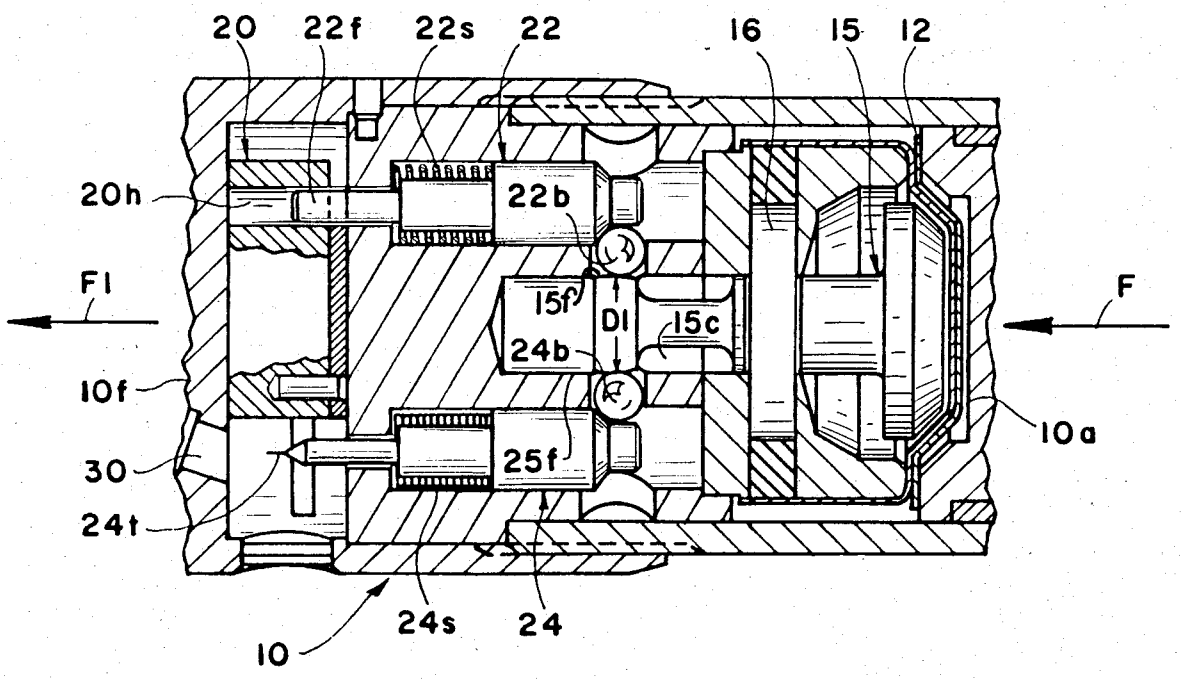
Fig. 1 PRIOR ART
FIG. 1 is a prior art fuze shown in cross-section and side view.

Once fore end 22*f* of rotor lock 22 clears hole 20*h* of rotor 20 the latter, after a preset delay, starts turning until the detonator 20*d*, as shown in FIG. 1A, is aligned with the striker's striking tip 24*t*. The rotor 20 is rotatably driven by a helical spring (not shown) via a gear train (not shown) as is conventional. The delay in rotation is accomplished by means of a clock mechanism, as is also conventional. Likewise, once arming pin 15 moves forward, ball 24*b* is pushed into cavity 15*c* as spring 24*s* and the set-back forces push the striker 24 backward. With the detonator 20*d* in rotor 20 aligned with tip 24*t* and the striker pushed back, the fuze is fully armed. Upon striking a target with sufficient impact to cause sufficient deceleration forces to be produced which overcome the forces of spring 24*s*, the striker 24 moves forward and its tip thus detonates the detonator 20*d*. It in turn activates pyrotechnic matter in channel 30 which causes the grenade to explode.

The arming of the standard fuze is thus dependent on whether or not the arming pin 15 has moved forward sufficiently so as to enable the two balls to be forced into cavity 15 thus enabling springs 22*s* and 24*s* to push the rotor lock back in order to unlock the rotor and to push the striker 24 aft. Herebefore, to prevent premature arming the shearing pin 16 has been included. The pin extends through arming pin 15. Only when a force, designated by arrow F is applied to diaphragm 12 is the force in the fore direction applied to the arming pin 15. Only when the force is sufficiently large is pin 16 sheared as the arming pin 15 moves forward and provides the space of cavity 15*c* for the balls to be pushed thereinto. The force F is typically provided as pressure of gases from a cartridge which is triggered in the launching rifle or for metal deformation caused by the travelling of a bullet slug sometimes referred to as a core, which in turn results in the bending of the diaphragm in the fore direction.

Although the standard fuze has been widely accepted, it has been discovered that to increase the safety provided by the fuze, one or more modifications need to be introduced. To appreciate the needed modifications we have to consider several possible situations. Let it be assumed that a soldier aimed at a reasonably far target from his position. Let it further be assumed that a tree is very close to the line of sight and that the tree is quite near the soldier. As the grenade is launched, the rotor lock 22 clears the rotor thus enabling it to rotate after the preset delay and the striker is pushed to the armed position. Let it further be assumed that for some reason the grenade hit the tree instead of passing by it. As a result of hitting the tree the entire grenade decelerates and thus a forward force F1 is applied to the entire fuze, including the striker. As a result of the deceleration the striker is pushed forward even though its spring 24*s* urges it backward. However, at this point due to the preset delay the rotor has not had time to rotate sufficiently so as to align the detonator 20*d* with the forwardly urged striker. Thus no detonation occurs. Once the deceleration forces which urge the striker 24*s* terminate the spring 24*s* pushes the striker 24 back once more. Upon hitting the ground the striker again may be urged forward due to the second deceleration of the rifle grenade. If at such time the rotor has turned sufficiently so as to align the detonator 20*d* with the tip 24*t* of the striker, the striker tip would detonate the detonator and thus initiate the explosion. Since the tree has been ostensibly very close to the soldier a danger exists that the soldier may be hurt if not killed.

It should be stressed that this disadvantage is due to the fact that the striker was free to advance more than once in the forward direction as if to strike the detonator. The first time occurs when the tree was hit and the second time when the rifle grenade hit the ground. In order to overcome this disadvantage, it has been determined that it can be overcome by locking the striker in the forward direction once it has moved forward as if to strike the detonator and prevent it from assuming successive forward positions.

Figure 2A:
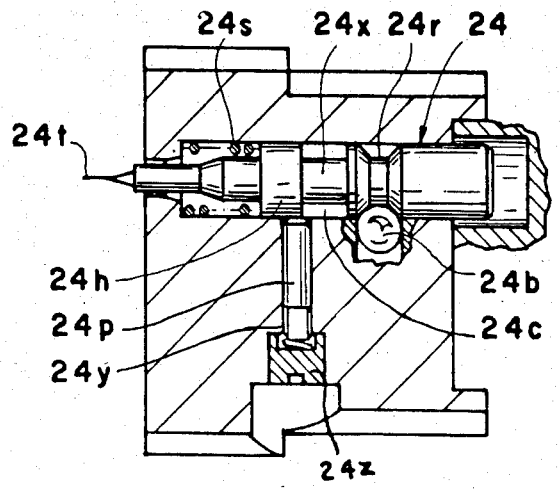
FIGS. 2A–2C are diagrams useful in explaining the striker locking improvement.
Figure 2B:
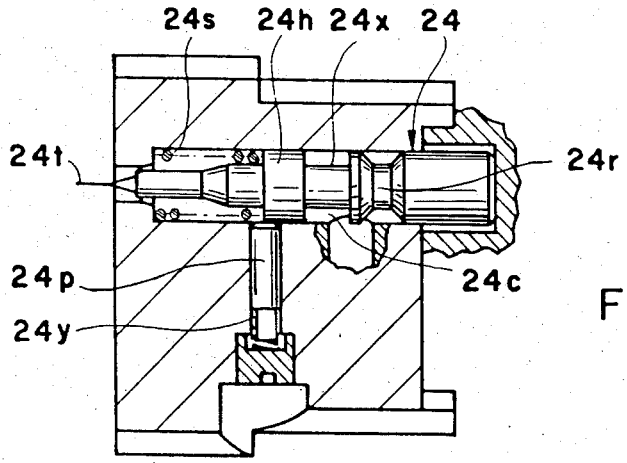
Figure 2C:
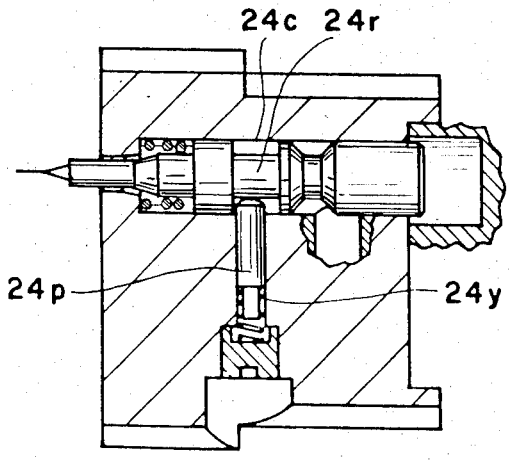

To highlight this aspect of the invention attention is directed to FIGS. 2A–2C. These three figures show one embodiment of the novel striker in different states. In these Figures elements like those previously described, which perform similar functions, are designated by like numerals. FIG. 2A shows the striker 24 in the unarmed state. FIG. 2B shows the striker in the armed state and FIG. 2C shows the striker locked once moving forward for the first time, in order to prevent repeated assumption of striking positions by the striker.

As shown in these Figures the striker body is not of uniform diameter. It includes a head section 24*h* with a section 24*x* aft of head section 24*h* and of smaller diameter. Aft of section 24*x* is a radial recess 24*r*. Its function is to accommodate part of steel ball 24*b* when the fuze is not armed. Also included in a radially inwardly directed pin 24*p*. It is spring biased by a spring 24*y* so that its tip first presses against the outer surface of head section 24*h* in two of the striker's three states. A plug 24*z* is shown holding the spring in place.

As long as the fuze is in the unarmed state, as shown in FIG. 2A, the pin 24*p* is pressed by spring 24*y* against the surface of head section 24*h* near section 24*x* which forms the inwardly directed cavity 24*c*. Once the arming pin 15 shears the shearing pin 16 due to any sufficiently large forward force F and moves fore, the spring 24*s* pushes the striker back, as shown in FIG. 2B. As the striker starts moving back the ball 24*b* is pushed out of recess 24*r* into the cavity 15*c* of the arming pin 15, and the pin 24*p* is pressed against a fore surface area of head section 24*h*. This represents the armed state. Upon hitting something, be it a target or a tree the fuze decelerates suddenly. Thus the striker is driven forward. The axial length of head section 24*h* is chosen so that upon being decelerated, the striker is forced sufficiently forward so that the tip of pin 24*p* is biased into cavity 24*c*, formed about section 24*x*. Once pin 24*p* is pushed against the outer surface of section 24*x*, as shown in FIG. 2C, the striker remains locked and cannot move forward a second time.

Considering the tree situation, once the rifle grenade hits the tree the striker gets locked up in the forward position. Since at this point the detonator 20*d* is not yet aligned with it, no detonation takes place. Detonation cannot occur later, such as when hitting the ground since the striker is locked up in the forward position.

Before describing other important modifications of the fuze it should be recalled that arming of the fuze requires the backward movement of the rotor lock 22 as a result of the spring bias provided by spring 22*s* so as to clear tip 22*f* of the rotor lock out of hole 20*h* in rotor 20. The rotor lock 22 is adapted to move back only after the arming pin 15 has moved forward to align cavity 15*c* with ball 22*b* to be pushed thereinto, i.e. as a result of an intentional launching. The only safety against prematurely releasing the rotor to turn is provided by the shearing pin. It must be sheared by arming pin 15 before the latter can move forward to provide clearing space for ball 22s.

In some cases the safety provided by the shearing pin from premature fuze arming is deemed insufficient. It is to provide a second condition for fuze arming that one aspect of the invention is directed. In accordance with the invention the rotor lock portion of the fuze is designed to prevent arming, i.e. exit of tip 22f out of rotor hole 20h to enable the rotor 20 to turn, even when ball 22b is cleared out of the way. A second condition must be met before tip 22f clears hole 20h and the rotor starts turning to align the detonator 20d with striking tip 24c. The second condition which has been chosen occurs only as a result of intentional grenade launching. This condition is the forces to which the rotor lock is subjected as a result of the rifle grenade acceleration on the order of 6000 G–7000 G, which are present only when the grenade is in route toward a target. Thus, the fuze cannot be armed except when subject to high acceleration away from the soldier.

Figure 3:
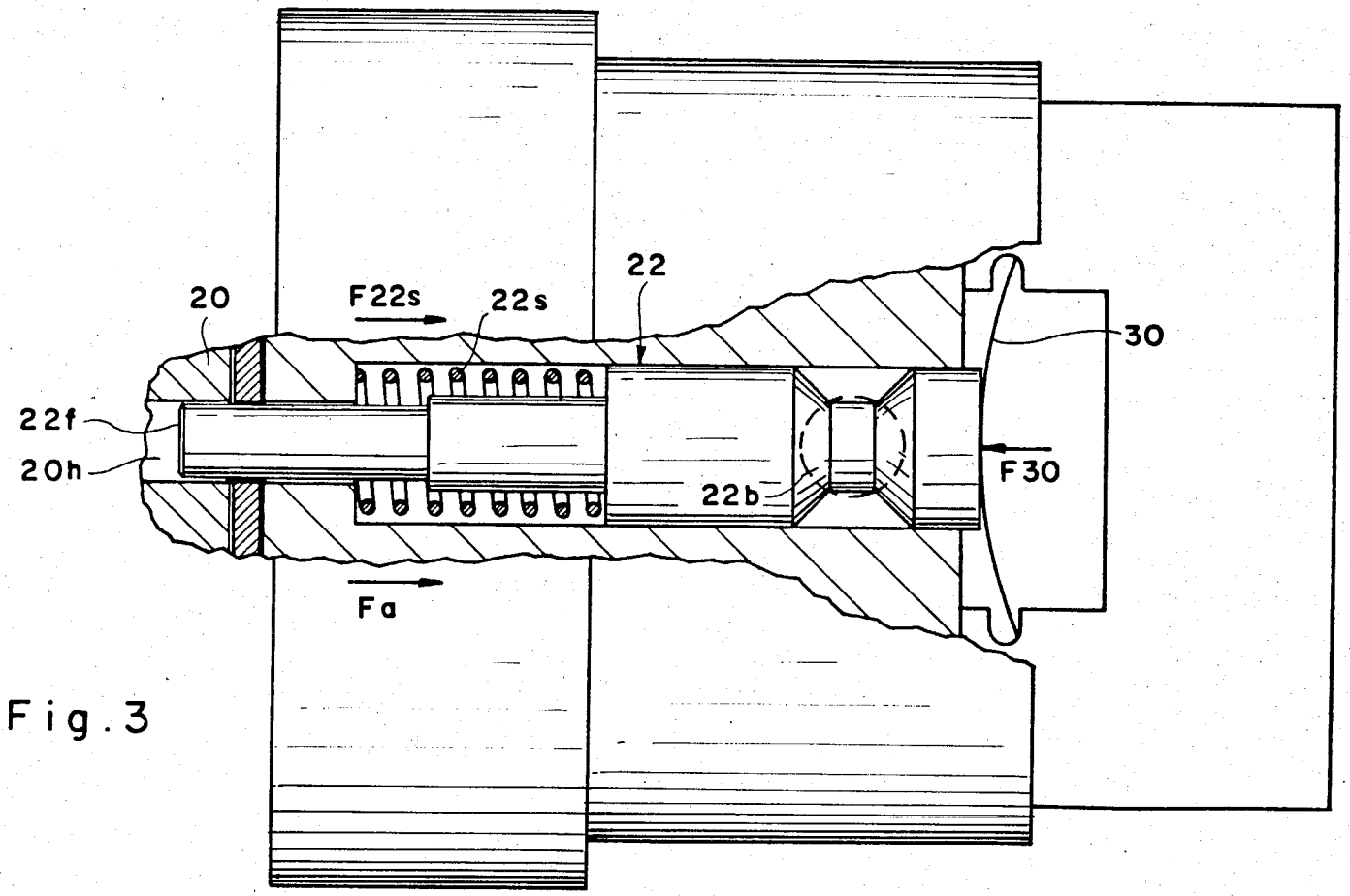
FIG. 3 is a diagram of rotor lock control with double safety.

This important aspect of the invention may be embodied in different versions or embodiments. Two different embodiments will be described in connection with FIG. 3 and FIGS. 4A–4C, respectively. As shown in FIG. 3 the rotor lock portion of the fuze is similar to that in the standard fuze except for one very unique and important feature. This feature is a spring element 30. It may assume any one of many configurations. Its function is to provide a force $F_{30}$ to the rotor lock 22. This force is in a direction opposite to that of the bias force provided by spring 22s.

The force $F_{30}$ provided by spring element 30 is sufficiently great so that even if the arming pin 15 accidentally moves forward, the force provided by spring 22s is insufficient to push the rotor lock back against the force $F_{30}$ and enable the tip 22f of the rotor lock to exit the hole 20h of rotor 20, and thereby arm the fuze. Thus the rotor remains secure even though the arming pin 15 accidentally moved forward after shearing pin 16. Only when the rifle grenade has been intentionally fired and the grenade's acceleration has reached a selected range, e.g. 6000 G–7000 G is the sum of the forces of spring 22s and the acceleration which produces a backward force on rotor lock 22 sufficiently high to overcome and exceed $F_{30}$. As a result 22f clears rotor hole 20h and the rotor 20 is free to rotate and thus arm the grenade. It should therefore be clear that by adding spring element 30 with a forward force $F_{30}$ on the rotor lock, fuze arming occurs only when the grenade accelerates in flight within a desired range even though before flight the arming pin moved forward due to an accident or the like. Thus a double safety is provided by the addition of the element 30 which produces the force $F_{30}$. $F_{30}$ is chosen as a function of the forces provided by spring 22s and the range at which the grenade has to accelerate before arming takes place.

Figure 4A:
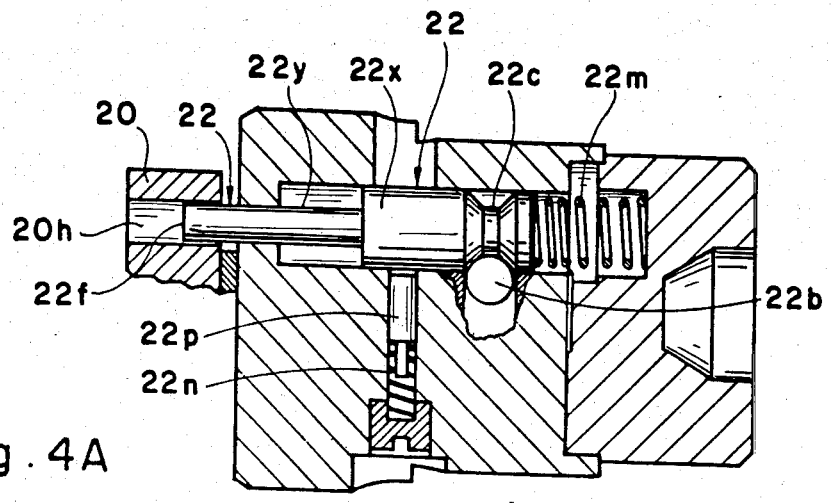
FIGS. 4A–4C are diagrams useful in explaining another embodiment of the rotor lock with double safety.
Figure 4B:
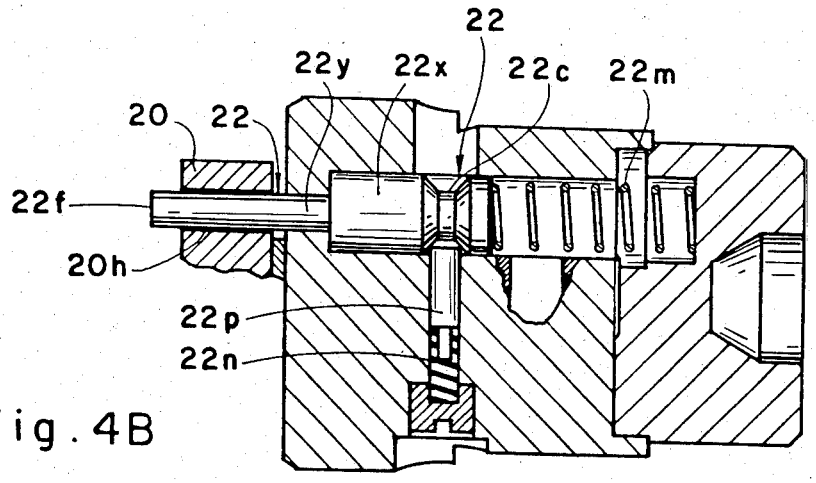
Figure 4C:
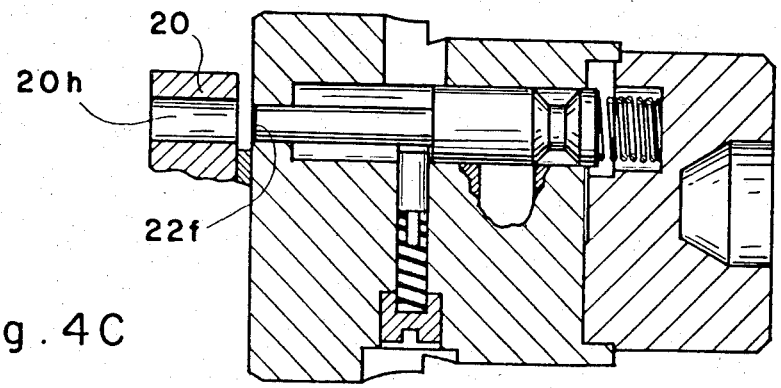

Another embodiment of double safety for the rotor lock wherein the release of the rotor 20 only occurs when the rifle grenade with the fuze reaches a certain acceleration, which occurs in flight toward a target will be explained in connection with FIGS. 4A–4C. FIGS. 4A–4C are used to show the states of the rotor lock arrangement before firing with the arming pin in the unarmed position, before firing but after the shearing pin 16 has been sheared by the arming pin 15, i.e. after first safety failure, and after firing in all cases, respectively. As shown the rotor lock 22 has a main section 22x of a selected diameter, with a post 22y extending forwardly therefrom. The rotor lock is shaped to form a cavity 22c aft of section 22x, which partially accommodates the steel ball 22b. Rather than spring 22s which biases the rotor lock in the aft direction (see FIG. 3) it includes a spring 22m, which biases the spring forward. A pin 22p, like pin 24p in FIGS. 2A–2C, is biased by a spring 22n radially inwardly to press against the rotor lock 22. When the arming pin 15 is in its unarmed state, the rotor lock arrangement is shown in FIG. 4A. That is the post 22y is partially in hole 20h of rotor 20 thus locking the latter. Ball 22b prevents the rotor lock from being pushed farther into hole 20h in spite of the bias force of spring 22m since ball 22b is not yet aligned with cavity 15c of the arming post. See FIG. 1.

If the arming pin fails in that it accidentally moves forward so that the ball 22b is pushed out of cavity 22c into cavity 15c of the arming pin 15 (see FIG. 1) due to the bias force of spring 22m, the rotor lock moves forward, thus farther advancing into the rotor hole 20h, as shown in FIG. 4B. Preferably the rotor lock arrangement is designed so that in this state the pin 22p advances into the recess 22c, previously partially occupied by ball 22b. Only after firing, when sufficiently large acceleration forces are applied to the rotor lock 22 is it pushed back. as shown in FIG. 4C. These forces cause the spring 22m to be compressed, while the rotor is armed by the top of the rotor lock 22f exiting hole 20h. Also the arrangement is designed so that when a desired acceleration is reached the rotor lock 22 is pushed sufficiently back so that pin 22p gets pressed against post 22y by spring 22n. Once this occurs the rotor lock remains in its aft position as shown in FIG. 4C. It should therefore be clear that the embodiment first described is one which provides double safety in that even if the arming were to fail and move forward the rotor remains locked until a sufficiently large aft force is applied to the rotor lock. This force is one produced only after grenade acceleration, i.e. after firing.

Although particular embodiments of the invention have been described and illustrated herein, it is recognized that modifications and variations may readily occur to those skilled in the art and consequently, it is intended that the claims be interpreted to cover such modifications and equivalents.

We claim:

1. In a fuze included in an assembly of the type used in connection with a rifle to launch and carry the assembly together with explosives to a target whereat the explosives explode as a result of the striking of detonator means by a striker of the fuze which in the armed state is biased by a spring away from the detonator means and which as a result of the impact with a target is urged forward against the detonator means to thus initiate the detonation of the explosives, an improvement comprising:

means for locking said striker once it has moved to a forward position irrespective of the presence or absence of detonator means ahead of it to prevent successive positioning of the striker in the forward position.

2. A fuze as recited in claim 1 wherein said striker locking means include an inwardly directed cavity formed in said striker aft of a head section thereof, and lock means extending into said cavity once the latter is aligned with the former when the striker assumes for the first time the forward position to thus lock the striker in said position, irrespective of the bias forces provided by the striker spring.

3. A fuze as recited in claim 2 wherein said lock means includes a pin and a pin associated spring for biasing said pin to engage said striker in a direction perpendicular to the striker axial direction, with the pin's position closest to the striker being accomodatable in the inwardly directed cavity of said striker to lock said striker in the forward position upon first reaching said position.

* * * * *